US006745491B1

(12) United States Patent
Hernandez-Zelaya

(10) Patent No.: US 6,745,491 B1
(45) Date of Patent: Jun. 8, 2004

(54) DRYER WALL CAP SYSTEM

(76) Inventor: Rodolfo Hernandez-Zelaya, 4217 E. 98th Ave., Tampa, FL (US) 33617-4432

( * ) Notice: Subject to any disclaimer, the term of this patent is extended or adjusted under 35 U.S.C. 154(b) by 0 days.

(21) Appl. No.: 10/442,626

(22) Filed: May 21, 2003

(51) Int. Cl.[7] ..... F26B 11/02

(52) U.S. Cl. ..... 34/140; 34/235; 34/138; 34/139

(58) Field of Search ..... 34/138, 139, 140, 34/601, 603, 604, 606, 235

(56) References Cited

U.S. PATENT DOCUMENTS 3,892,049 A * 7/1975 Adams, Jr. ..... 34/235
5,121,948 A * 6/1992 Anderson et al. ..... 285/147.1
5,287,665 A * 2/1994 Rath, Jr. ..... 52/220.8
5,590,477 A * 1/1997 Carfagno, Sr. ..... 34/235
6,230,418 B1 * 5/2001 Gomulinski ..... 34/160
6,419,102 B1 * 7/2002 Harpenau ..... 220/3.3

* cited by examiner

*Primary Examiner*—Ira S. Lazarus
*Assistant Examiner*—Kathryn S. O'Malley
(74) *Attorney, Agent, or Firm*—Edward P. Dutkiewicz

(57) ABSTRACT

An intermediate assembly has a vertical plate with a rectangular opening. The intermediate assembly has a container with side walls and a rear wall and a horizontal upper wall. The upper wall has parallel side edges rearwardly and a semicircular edge forwardly. A securement frame has a forward periphery with a rearward projection removably positioned within the opening in the plate. A tube assembly includes an upper tube positionable above the upper wall and a lower tube coaxial with the upper tube and positionable below the upper wall.

4 Claims, 3 Drawing Sheets

DRYER WALL CAP SYSTEM

BACKGROUND OF THE INVENTION

1. Field of the Invention

The present invention relates to a dryer wall cap system and more particularly pertains to providing safe and convenient venting of clothes dryers.

2. Description of the Prior Art

The use of dryer venting systems of known designs and configurations is known in the prior art. More specifically, dryer venting systems of known designs and configurations previously devised and utilized for the purpose of venting clothes dryers are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a dryer wall cap system that allows safe and convenient venting of clothes dryers.

In this respect, the dryer wall cap system according to the present invention substantially departs from the conventional concepts and designs of the prior art, and in doing so provides an apparatus primarily developed for the purpose of providing safe and convenient venting of clothes dryers.

Therefore, it can be appreciated that there exists a continuing need for a new and improved dryer wall cap system which can be used for safe and convenient venting of clothes dryers. In this regard, the present invention substantially fulfills this need.

SUMMARY OF THE INVENTION

In view of the foregoing disadvantages inherent in the known types of dryer venting systems of known designs and configurations now present in the prior art, the present invention provides an improved dryer wall cap system. As such, the general purpose of the present invention, which will be described subsequently in greater detail, is to provide a new and improved dryer wall cap system and method which has all the advantages of the prior art and none of the disadvantages.

To attain this, the present invention essentially comprises a vertical wall having a rectangular opening with a vertical stud there adjacent. The wall has an interior surface and an exterior surface.

An intermediate assembly is next provided. The intermediate assembly has a vertical plate positionable in contact with the exterior surface of the wall with a rectangular opening aligned with the rectangular opening of the wall. The vertical plate has nail apertures for attachment to the stud. The intermediate assembly has a container with side walls and an arcuate rear wall. The container has a horizontal upper wall extending rearwardly from the opening of the plate. The upper wall has parallel side edges rearwardly and a semicircular edge forwardly.

Next provided is a securement frame. The securement frame has a forward periphery positionable in contact with the exterior surface of the wall adjacent to the opening in the wall with a rearward projection removably positioned within the opening in the plate.

A tube assembly is next provided. The tube assembly includes an upper tube positionable above the upper wall.

The tube assembly also has a lower tube coaxial with the upper tube and positionable below the upper wall. The tube assembly has two parallel plates adjacent the upper and lower tubes. The two parallel plates include an upper plate extending rearwardly in contact with the upper surface of the horizontal plate and a lower plate with an arcuate portion extending forwardly and a rectangular portion extending rearwardly in contact with the lower surface of the horizontal plate.

Next, a flexible tube is provided. The flexible tube is coupled to the upper tube for venting the contents of a clothes dryer to the outside.

Lastly, a flexible tube is coupled to the lower tube for receiving the exhaust of a clothes dryer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dryer wall cap system which has all of the advantages of the prior art dryer venting systems of known designs and configurations and none of the disadvantages.

It is another object of the present invention to provide a new and improved dryer wall cap system which may be easily and efficiently manufactured and marketed.

It is further an object of the present invention to provide a new and improved dryer wall cap system which is of durable and reliable constructions.

An even further object of the present invention is to provide a new and improved dryer wall cap system which is susceptible of a low cost of manufacture with regard to both materials and labor, and which accordingly is then susceptible of low prices of sale to the consuming public, thereby making such dryer wall cap system economically available to the buying public.

Even still another object of the present invention is to provide a dryer wall cap system for safe and convenient venting of clothes dryers.

Lastly, it is an object of the present invention to provide a new and improved dryer wall cap system having an intermediate assembly with a vertical plate with a rectangular opening. The intermediate assembly has a container with side walls and a rear wall and a horizontal upper wall.

The upper wall has parallel side edges rearwardly and a semicircular edge forwardly. A securement frame has a forward periphery with a rearward projection removably positioned within the opening in the plate. A tube assembly includes an upper tube positionable above the upper wall and a lower tube coaxial with the upper tube and positionable below the upper wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
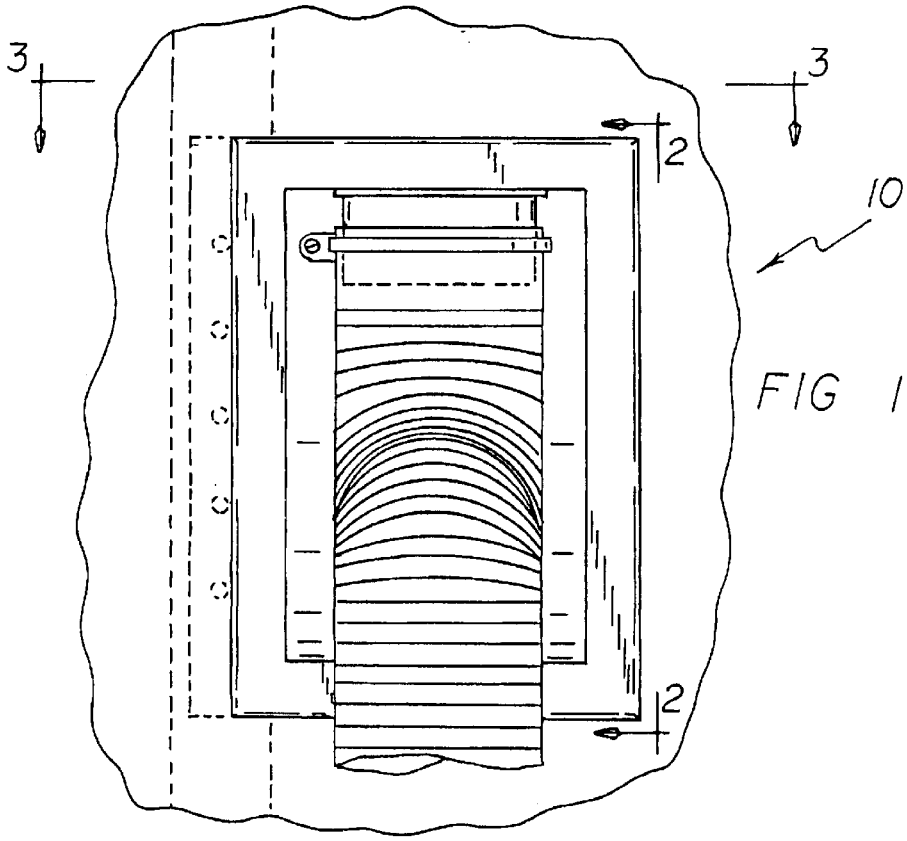
FIG. 1 is a front elevational view of a dryer wall cap system constructed in accordance with the principles of the present invention.
Figure 2:
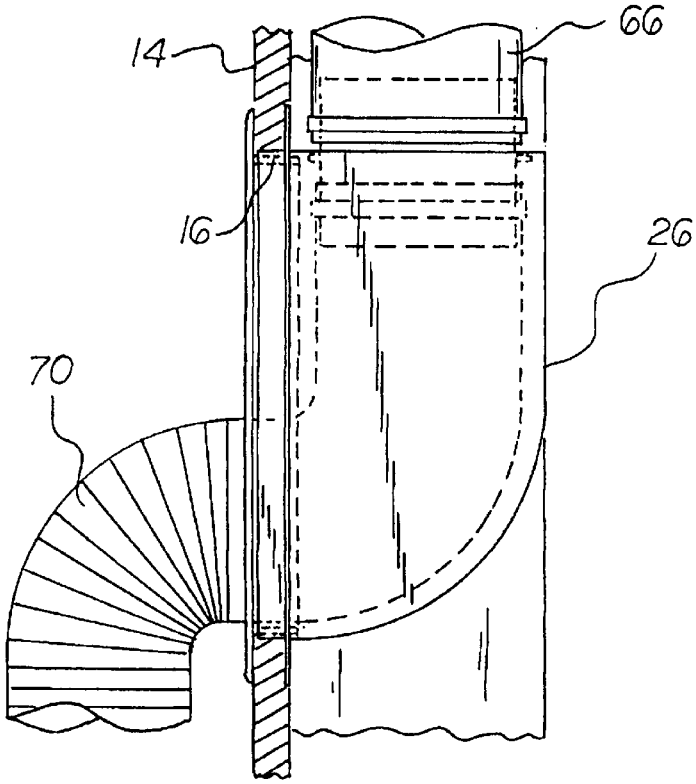
FIG. 2 is a side elevational view, partly in cross section, taken along line 2—2 of FIG. 1.
Figure 3:
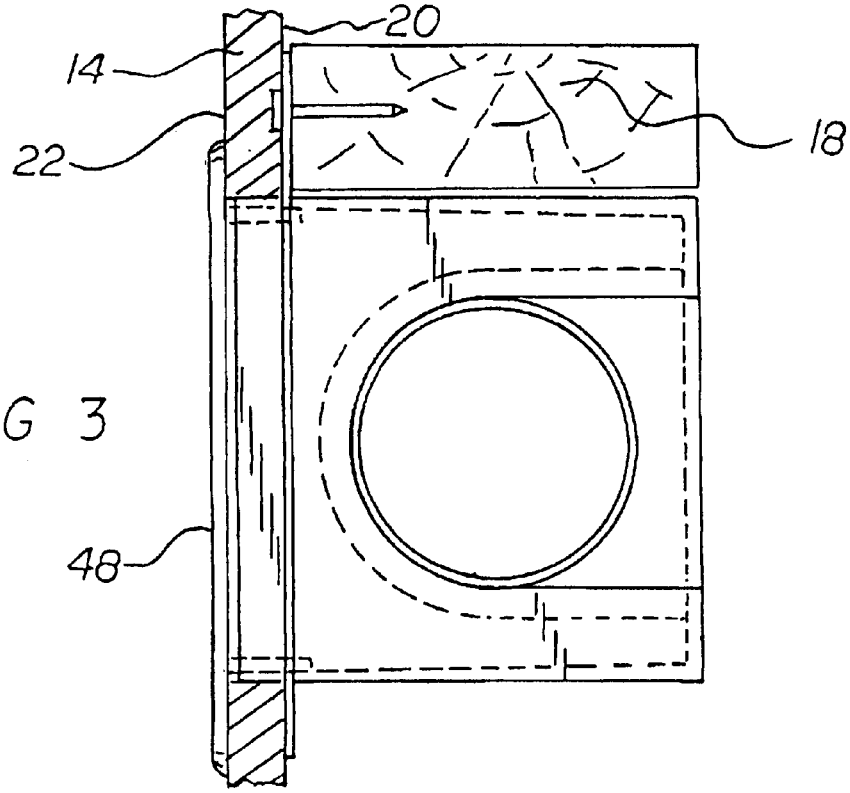
FIG. 3 is a cross sectional view taken along line 3—3 of FIG. 1.
Figure 4:
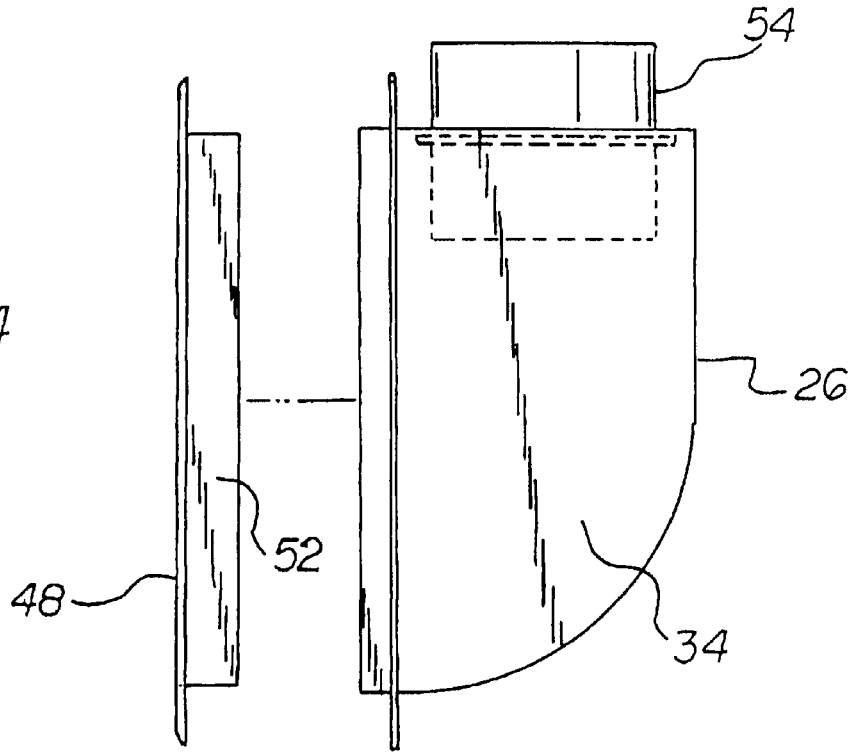
FIG. 4 is an exploded side elevational view similar to FIG. 2 but with the wall removed.
Figure 5:
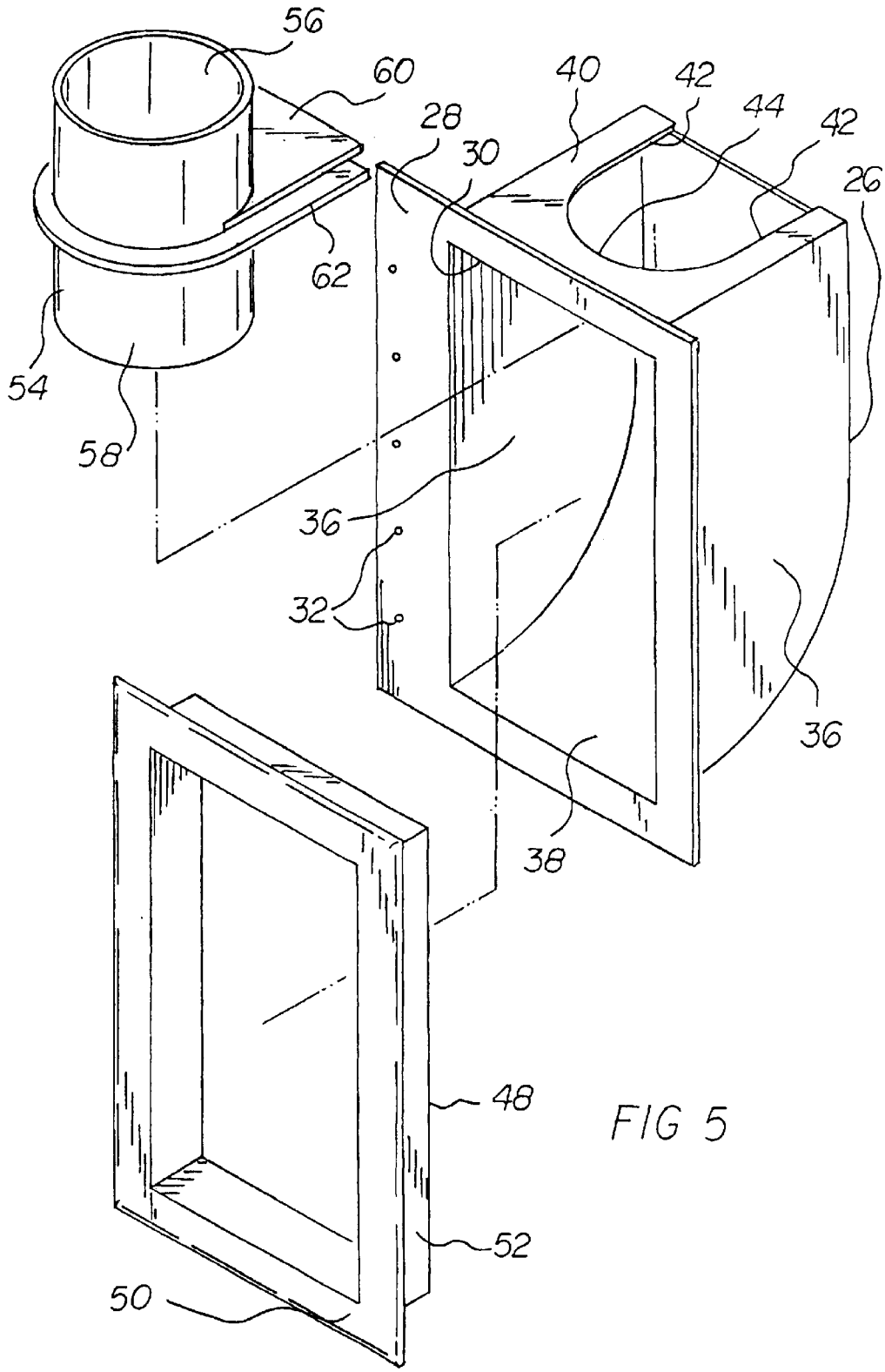
FIG. 5 is an exploded perspective view of the system shown in the prior Figures.

With reference now to the drawings, and in particular to FIG. 1 thereof, the preferred embodiment of the new and improved dryer wall cap system embodying the principles and concepts of the present invention and generally designated by the reference numeral 10 will be described.

The present invention, the dryer wall cap system 10 is comprised of a plurality of components. Such components in their broadest context include a semi-automatic firearm, a trigger, a disconnector, a trigger mounting pin, a trigger disconnector spring, a hammer, a hammer mounting pin, a hammer spring, a cam body assembly, a safety selector, and a trigger extender. Such components are individually configured and correlated with respect to each other so as to attain the desired objective.

First provided is a vertical wall 14 having a rectangular opening 16 with a vertical stud 18 there adjacent. The wall has an interior surface 20 and an exterior surface 22.

An intermediate assembly 26 is next provided. The intermediate assembly has a vertical plate 28 positionable in contact with the exterior surface of the wall with a rectangular opening 30 aligned with the rectangular opening of the wall. The vertical plate has nail apertures 32 for attachment to the stud. The intermediate assembly has a container 34 with side walls 36 and an arcuate rear wall 38. The container has a horizontal upper wall 40 extending rearwardly from the opening of the plate. The upper wall has parallel side edges 42 rearwardly and a semicircular edge 44 forwardly.

Next provided is a securement frame 48. The securement frame has a forward periphery 50 positionable in contact with the exterior surface of the wall adjacent to the opening in the wall with a rearward projection 52 removably positioned within the opening in the plate.

A tube assembly 54 is next provided. The tube assembly includes an upper tube 56 positionable above the upper wall. The tube assembly also has a lower tube 58 coaxial with the upper tube and positionable below the upper wall. The tube assembly has two parallel plates 60, 62 adjacent the upper and lower tubes. The two parallel plates include an upper plate 60 extending rearwardly in contact with the upper surface of the horizontal plate and a lower plate 62 with an arcuate portion extending forwardly and a rectangular portion extending rearwardly in contact with the lower surface of the horizontal plate.

Next, a flexible tube 66 is provided. The flexible tube is coupled to the upper tube for venting the contents of a clothes dryer to the outside.

Lastly, a second flexible tube 70 is coupled to the lower tube for receiving the exhaust of a clothes dryer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dryer wall cap system for providing safe and convenient venting of clothes dryers comprising, in combination:

a vertical wall having a rectangular opening with a vertical stud there adjacent, the wall having an interior surface and an exterior surface;

an intermediate assembly having a vertical plate positionable in contact with the exterior surface of the wall with a rectangular opening aligned with the rectangular opening of the wall, the vertical plate having nail apertures for attachment to the stud, the intermediate assembly having a container with side walls and an arcuate rear wall and a horizontal upper wall extending rearwardly from the opening of the plate, the upper wall having parallel side edges rearwardly and a semicircular edge forwardly;

a securement frame having a forward periphery positionable in contact with the exterior surface of the wall adjacent to the opening in the wall with a rearward projection removably positioned within the opening in the plate;

a tube assembly including an upper tube positionable above the upper wall and a lower tube coaxial with the upper tube and positionable below the upper wall, the tube assembly having two parallel plates adjacent the upper and lower tubes, the two parallel plates including an upper plate extending rearwardly in contact with the upper surface of the horizontal plate and a lower plate with an arcuate portion extending forwardly and a rectangular portion extending rearwardly in contact with the lower surface of the horizontal plate, a flexible tube coupled to the upper tube for venting the contents of a clothes dryer to the outside; and a flexible tube coupled to the lower tube for receiving the exhaust of a clothes dryer.

2. A dryer wall cap system comprising:

an intermediate assembly having a vertical plate with a rectangular opening, the intermediate assembly having a container with side walls and a rear wall and a horizontal upper wall, the upper wall having parallel side edges rearwardly and a semicircular edge forwardly;

a securement frame having a forward periphery with a rearward projection removably positioned within the opening in the plate;

a tube assembly including an upper tube positionable above the upper wall and a lower tube coaxial with the upper tube and positionable below the upper wall.

3. The system as set forth in claim 2 and further including two parallel plates adjacent to the upper and lower tubes, the two parallel plates including an upper plate extending rearwardly in contact with the upper surface of the horizontal plate and a lower plate with an arcuate portion extending forwardly and a rectangular portion extending rearwardly in contact with the lower surface of the horizontal plate.

4. The system as set forth in claim 2 and further including:

a flexible tube coupled to the upper tube for venting the contents of a clothes dryer to the outside; and a flexible tube coupled to the lower tube for receiving the exhaust of a clothes dryer.

* * * * *